US008277290B2

(12) United States Patent
Chiu et al.

(10) Patent No.: US 8,277,290 B2
(45) Date of Patent: Oct. 2, 2012

(54) POLISHING PAD AND POLISHING DEVICE

(75) Inventors: Allen Chiu, Tao-Yuan Hsien (TW); Yu-Lung Jeng, Tao-Yuan Hsien (TW)

(73) Assignee: Bestac Advanced Material Co., Ltd., Tao-Yuan Hsien (TW)

( * ) Notice: Subject to any disclaimer, the term of this patent is extended or adjusted under 35 U.S.C. 154(b) by 481 days.

(21) Appl. No.: 12/550,544

(22) Filed: Aug. 31, 2009

(65) Prior Publication Data

US 2010/0273404 A1 Oct. 28, 2010

(30) Foreign Application Priority Data

Apr. 24, 2009 (TW) ..... 98206871 U

(51) Int. Cl.
*B24B 5/00* (2006.01)

(52) U.S. Cl. ..... 451/285; 451/533; 451/538; 451/539

(58) Field of Classification Search ..... 451/533, 451/538, 539, 285–290
See application file for complete search history.

(56) References Cited

U.S. PATENT DOCUMENTS

| | | | | |
|---|---|---|---|---|
| 5,516,400 | A * | 5/1996 | Pasch et al. | 451/56 |
| 5,885,148 | A * | 3/1999 | Vargas et al. | 451/523 |
| 6,838,169 | B2 * | 1/2005 | Obeng | 428/354 |
| 2004/0146712 | A1 * | 7/2004 | Obeng | 428/411.1 |
| 2005/0221723 | A1 * | 10/2005 | Duboust et al. | 451/41 |
| 2006/0135051 | A1 * | 6/2006 | Meyer et al. | 451/538 |
| 2010/0267318 | A1 * | 10/2010 | Duboust et al. | 451/533 |

FOREIGN PATENT DOCUMENTS

| | | |
|---|---|---|
| TW | 200709894 | 3/2007 |
| TW | I295949 | 4/2008 |

* cited by examiner

*Primary Examiner* — Maurina Rachuba
(74) *Attorney, Agent, or Firm* — Ming Chow; Sinorica, LLC

(57) ABSTRACT

A polishing pad used in semiconductor polishing process is provided in the present invention and a pressure sensitive adhesive is used to couple the polishing pad. The polishing pad includes a substrate, and the substrate includes a polishing surface and a reverse surface corresponding to the polishing surface. The polishing pad is characterized by: a pressure sensitive adhesive formed on the reverse surface of the substrate and used to couple with a bottom layer, and the horizontal adhesion of the pressure sensitive adhesive is higher than the vertical adhesion of the pressure sensitive adhesive.

20 Claims, 5 Drawing Sheets

40

POLISHING PAD AND POLISHING DEVICE

BACKGROUND OF THE INVENTION

1. Technical Field

The present invention is related to a polishing pad used in a semiconductor polishing process, and more particularly is related to a polishing pad utilizing a pressure sensitive adhesive to couple.

2. Description of Related Art

Microelectronic chips are made by depositing different thin film materials on a semiconducting wafer. When a thin film material is deposited onto a wafer surface, a polishing process is employed to evenly remove the protruded portion of the deposit layer so as to planarize the wafer topography for subsequent IC manufacturing processes to proceed. This polishing procedure is so-called Chemical Mechanical Polishing (CMP). The chips are made by repeating deposition of thin-film materials, and thus many CMP steps are generally required.

In the conventional CMP process, the polishing pad is fixed on a bottom layer or a plurality of polishing pads are coupled together to form a compound polishing pad. When the polishing pad is fixed on the polishing device, a glue or adhesive liquid is used to couple the polishing pad and the polishing device. When polishing, a wafer is rotating against the polishing pad surface. The shear force generated by the polishing action will cause delamination of the polishing pad. Therefore, the polishing step is necessary to stop and the wafer may be damaged.

According to the problem described above, a polishing pad used for polishing process is disclosed in the present invention. A pressure sensitive adhesive is used to couple the polishing pad or is used to couple the polishing pad with the polishing device. The pressure sensitive adhesive has a sufficient and higher horizontal adhesion than the vertical adhesion. The polishing pad will not be delaminated by the shearing force generated by polishing action. Further the vertical adhesion of the pressure sensitive from the pad is just sufficient to couple the polishing device, and thus the polishing pad can be easily released from the polishing device.

BRIEF SUMMARY OF THE INVENTION

In order to solve the problems described above, the main object of the present invention is to provide a polishing pad used in the semiconductor polishing process and the polishing pad is fixed on a bottom layer by a pressure sensitive adhesive.

Another object of the present invention is to provide a polishing pad used in the semiconductor polishing process and a plurality of the polishing pads are stacked together by the pressure sensitive adhesive to form a compound polishing pad.

One another object of the present invention is to provide a polishing pad used in the semiconductor polishing process and the polishing pad is fixed on the polishing device by the pressure sensitive adhesive.

One other object of the present invention is to provide a polishing pad used in the semiconductor polishing process and a pressure sensitive adhesive is used to couple the polishing pad. The pressure sensitive adhesive has a sufficient and higher horizontal adhesive strength than the vertical adhesive strength. The polishing pad will not be delaminated by the shearing force generated by polishing action.

One other object of the present invention is to provide a polishing pad used in the semiconductor polishing process and a pressure sensitive adhesive is used to couple the polishing pad. The horizontal adhesion of the pressure sensitive adhesive is higher than the vertical adhesion of the pressure sensitive adhesive. Because the vertical adhesion of the pressure sensitive is lower, the polishing pad is easy to release from the polishing device.

According to the objects described above, a polishing pad used in semiconductor polishing process is disclosed in the present invention and a pressure sensitive adhesive is used to couple the polishing pad. The polishing pad includes a substrate, and the substrate includes a polishing surface and a reverse surface corresponding to the polishing surface. The polishing pad is characterized by: a pressure sensitive adhesive formed on the reverse surface of the substrate and used to couple with a bottom layer, and the horizontal adhesion of the pressure sensitive adhesive is higher than the vertical adhesion of the pressure sensitive adhesive.

A polishing device is also disclosed in the present invention and the polishing device includes a first platform, a second platform, a driving device, a pressure device and a polishing pad. The polishing pad is made by at least one substrate. The substrate includes a polishing surface and a reverse surface respectively corresponding to the polishing surface. The first platform is coupled to the reverse surface of the substrate, and the second platform is used to carry the semiconductor element. The driving device is used to drive the first platform to rotate, and the pressure device is used to generate a specific pressure between the polishing pad of the first platform and the semiconductor element of the second platform. The polishing pad is characterized by: a pressure sensitive adhesive is formed on the reverse surface of the substrate and used to couple with the first platform, and the horizontal adhesion of the pressure sensitive adhesive is higher than the vertical adhesion of the pressure sensitive adhesive and the reverse surface of the substrate is binding with the first platform instead of separating during polishing.

DETAILED DESCRIPTION OF THE INVENTION

The present invention discloses a polishing pad and polishing device are used in semiconductor polishing process. In the present invention, some details for manufacturing or processing polishing pad or polishing device are achieved by applying conventional art, and therefore are not completely depicted in below description. And the drawings referred to in the following are not made according to the actual related sizes, the function of which is only to express and illustrate characteristics of the present invention.

Figure 1A:
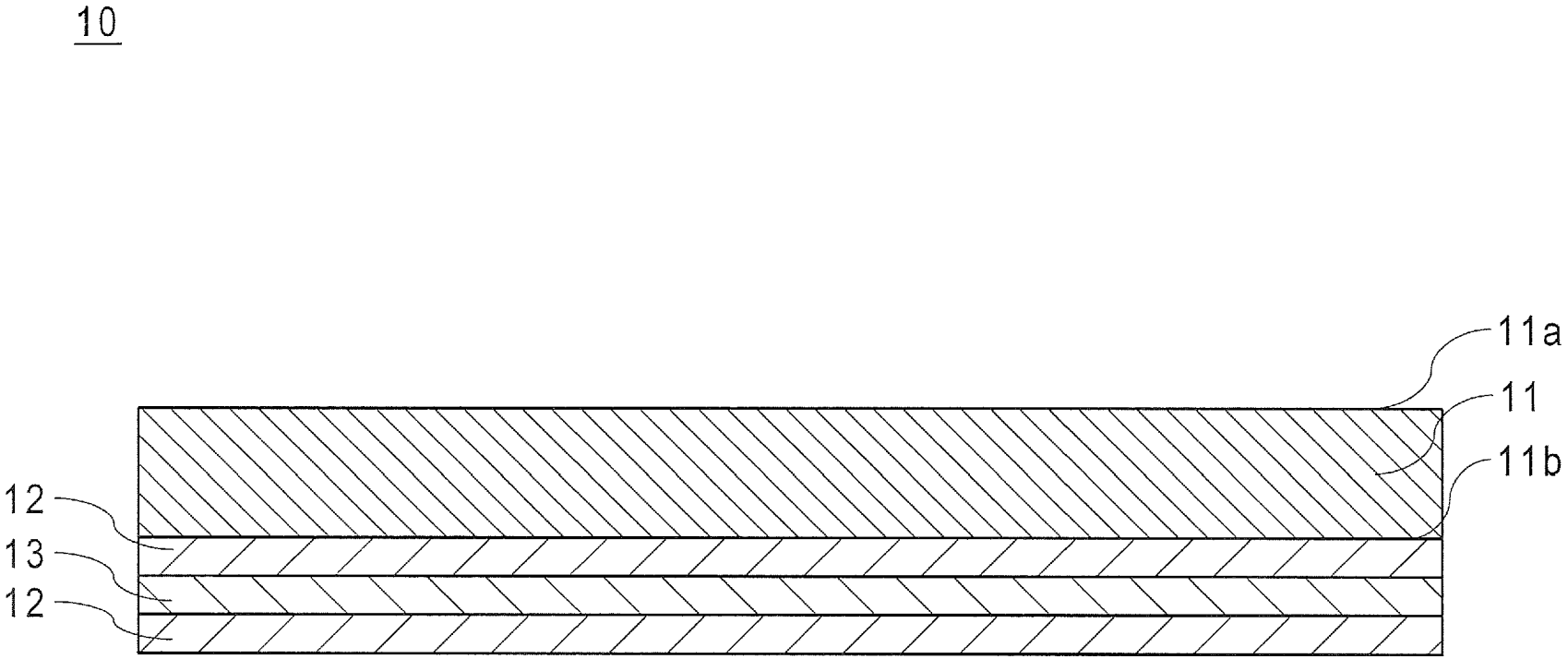
FIG. 1A is a view illustrating a polishing pad in one embodiment of the present invention.

Please referring to FIG. 1A, it is a preferred embodiment of the polishing device according to the present invention. As shown in FIG. 1A, a polishing pad 10 used in semiconductor polishing process includes a substrate 11. The polishing pad 11 includes a polishing surface 11*a* and a reverse surface 11*b* corresponding to the polishing surface 11*a*. The polishing pad 10 is characterized by: a pressure sensitive adhesive 12 is formed on the reverse surface 11*b* of the substrate 11 and used to couple with a bottom layer 13. The horizontal adhesion of the pressure sensitive adhesive 12 is higher than the vertical adhesion of the pressure sensitive adhesive 12. The reverse surface 11*b* of the substrate 11 is binding with the bottom layer 13 instead of separating. The horizontal adhesion of the pressure sensitive adhesive 12 is about 0.3-3 kg/cm and the vertical adhesion of the pressure sensitive adhesive 12 is about 0.05-0.55 kg/cm.

According to the description above, the shape and the area of the substrate 11 and the bottom layer 13 are almost the same. The bottom layer 13 coupled with the reverse surface 11*b* of the substrate 11 is a PET Mylar and the substrate 11 is a polymer. The polymer is elected from the group consisted of polycarbonate, nylon, polyolefin, polyvinyl alcohol, polyacrylate, polytetrafluoroethylene, polyethylene terephthalate, polyimide, poly amide, poly aryl stretch, poly styrene, polymethyl methacrylate and compound thereof. The substrate 11 and the bottom layer 13 include at least one property. The property is selected from the group consisting of hardness, density, porosity, compressibility, rigidity, tensile modulus, bulk modulus of elasticity, transparency, chemical composition, rheology, creep, glass transition temperature, melting temperature, viscosity and combination thereof. In addition, if the substrate 11 includes a multi-holes structure, the bottom layer 13 includes a hole less structure and vise versa. Besides, there is at least one of transparent window, trench or through hole disposed on the polishing surface 11*a* of the first substrate 11. The transparent window disposed on the polishing pad 11*a* of the substrate 11 is used to observe the polishing of the semiconductor. The trench or through hole disposed on the polishing pad 11*a* of the substrate 11 is used to let the polishing liquid evenly spread on the polishing pad 11*a* of the substrate 11 and avoid the scratch of the semiconductor generated by the deposition of the impurities during polishing. The method to dispose the transparent window, trench or through hole is a prior art and the detail description is omitted herein.

Figure 1B:
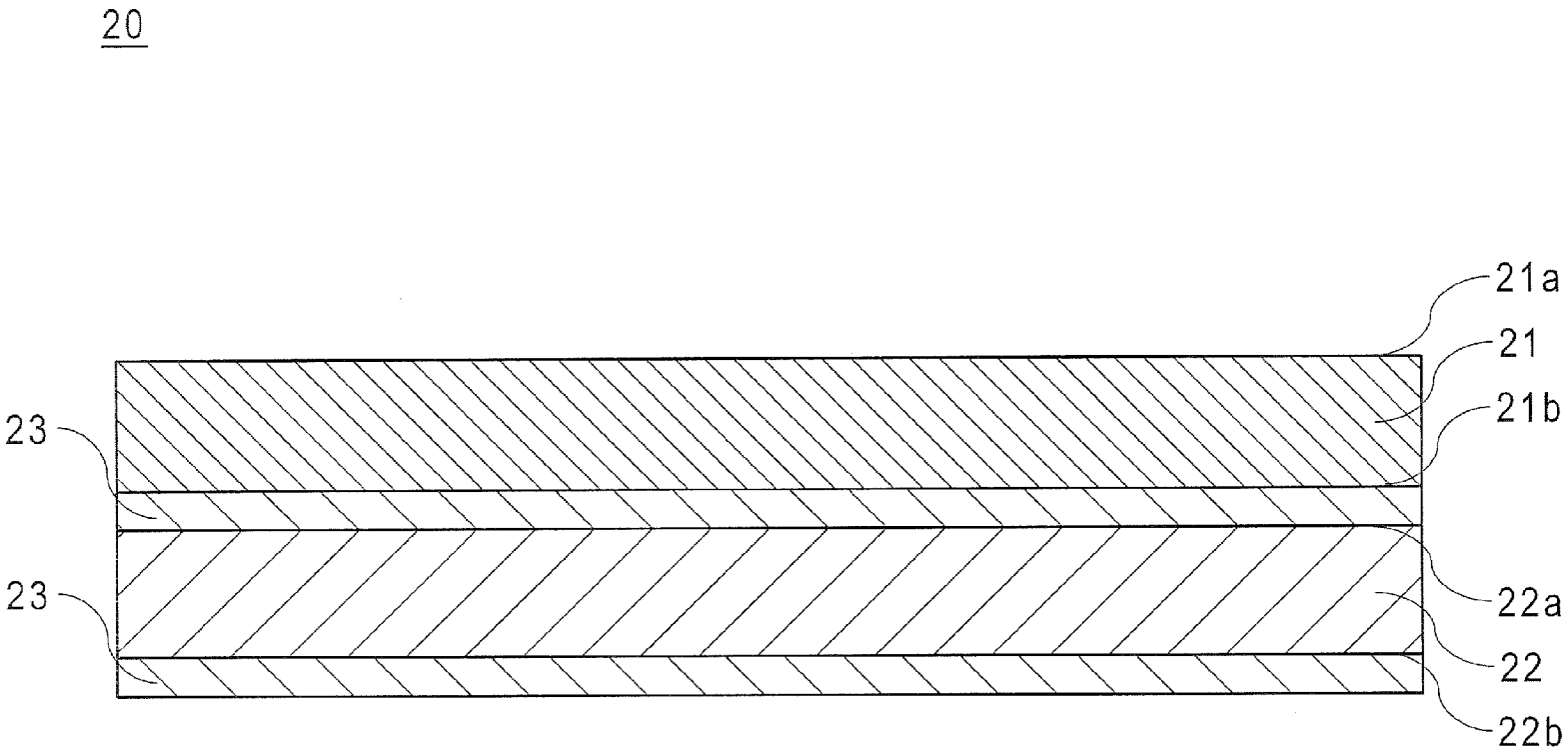
FIG. 1B is a view illustrating a compound polishing pad in one embodiment of the present invention.

Referring to FIG. 1B, it is another preferred embodiment of the polishing device according to the present invention. As shown in FIG. 1B, a polishing pad 20 is used in a semiconductor polishing process and the polishing pad 20 is made by at least one first substrate 21 and at least one second substrate 22. The first substrate 21 and the second substrate 22 respectively include a polishing surface 21*a* and 22*a* and a reverse surface 21*b* and 22*b* respectively corresponding to the polishing surface 21*a* and 22*a*. The polishing pad 20 is characterized by: a pressure sensitive adhesive 23 is formed on the reverse surface 21*b* of the first substrate 21 and used to couple with the polishing surface 22*a* of the second substrate 22. A plurality of the polishing pads 20 is coupled together to form a compound polishing pad by the pressure sensitive adhesive 23. The horizontal adhesion of the pressure sensitive adhesive 23 is higher that the vertical adhesion of the pressure sensitive adhesive 23. The reverse surface 21*b* of the substrate 21 is binding with the polishing surface 22*a* of the second substrate 22 instead of separating. The horizontal adhesion of the pressure sensitive adhesive 23 is about 0.3-3 kg/cm and the vertical adhesion of the pressure sensitive adhesive 23 is about 0.05-0.55 kg/cm.

According to the description above, the shape and the area of the first substrate 21 and the second substrate 22 are almost the same. The first substrate 21 includes a first polymer and the second substrate 22 includes a second polymer. The first polymer and the second polymer are elected from the group consisted of Polycarbonate, nylon, polyolefin, polyvinyl alcohol, polyacrylate, polytetrafluoroethylene, polyethylene terephthalate, polyimide, poly amide, poly aryl stretch, poly styrene, polymethyl methacrylate and compound thereof. The first substrate 21 and the second substrate 22 include at least one property. The property is selected from the group consisting of hardness, density, porosity, compressibility, rigidity, tensile modulus, bulk modulus of elasticity, transparency, chemical composition, rheology, creep, glass transition temperature, melting temperature, viscosity and combination thereof. In addition, if the first substrate 21 includes a multi-holes structure, the second substrate 22 includes a hole less structure and vise versa. Besides, there is at least one of transparent window, trench or through hole disposed on the polishing surface 21*a* of the first substrate 21. The transparent window disposed on the polishing pad 21*a* of the first substrate 21 is used to observe the polishing of the semiconductor. The trench or through hole disposed on the polishing pad 21*a* of the first substrate 21 is used to let the polishing liquid evenly spread on the polishing pad 21*a* of the first substrate 21 and avoid the scratch of the semiconductor generated by the deposition of the impurities during polishing. The method to dispose the transparent window, trench or through hole is a prior art and the detail description is omitted herein.

Figure 1C:
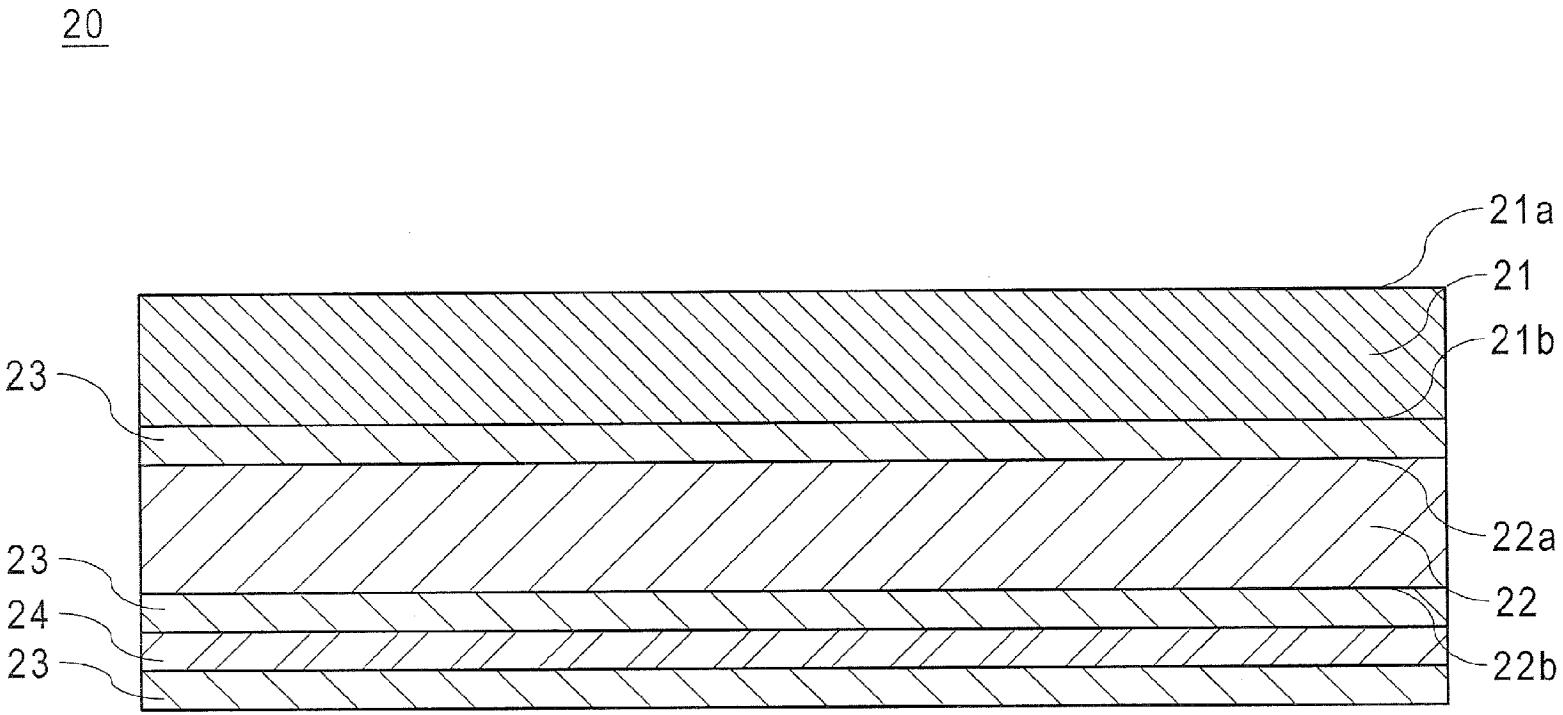
FIG. 1C is a view illustrating a compound polishing pad in one embodiment of the present invention.

Referring to FIG. 1C, it is one another preferred embodiment of the polishing device according to the present invention. The structure is similar to that in FIG. 1B, a bottom layer 24 further included in the present embodiment and used to couple with the polishing pad 20. As shown in FIG. 1C, a pressure sensitive adhesive 23 is formed on the reverse surface 22*b* of the second substrate 22 and used to couple with the bottom layer 24.

According to the description above, the shape and the area of the second substrate 22 and the bottom layer 24 are almost the same. The bottom layer 24 coupled with the reverse surface 22*b* of the second surface 22 is a PET Mylar. The bottom layer 24 includes a third polymer. The third polymer is elected from the group consisted of Polycarbonate, nylon, polyolefin, polyvinyl alcohol, polyacrylate, polytetrafluoroethylene, polyethylene terephthalate, polyimide, poly amide, poly aryl stretch, poly styrene, polymethyl methacrylate and compound thereof. The first substrate 21, the second substrate 22 and the bottom layer 24 include at least one property. The property is selected from the group consisting of hardness, density, porosity, compressibility, rigidity, tensile modulus, bulk modulus of elasticity, transparency, chemical composition, rheology, creep, glass transition temperature, melting temperature, viscosity and combination thereof. In addition, if the first substrate 21 includes a multi-holes structure, the bottom layer 24 includes a hole less structure and vise versa. And if the second substrate 22 includes a multi-holes structure, the bottom layer 24 includes a hole less structure and vise versa. The first substrate 21 and the second substrate 22 of the present embodiment is the same as the first substrate 21 and the second substrate 22 in FIG. 1B, the detail description is omitted herein.

Figure 2A:
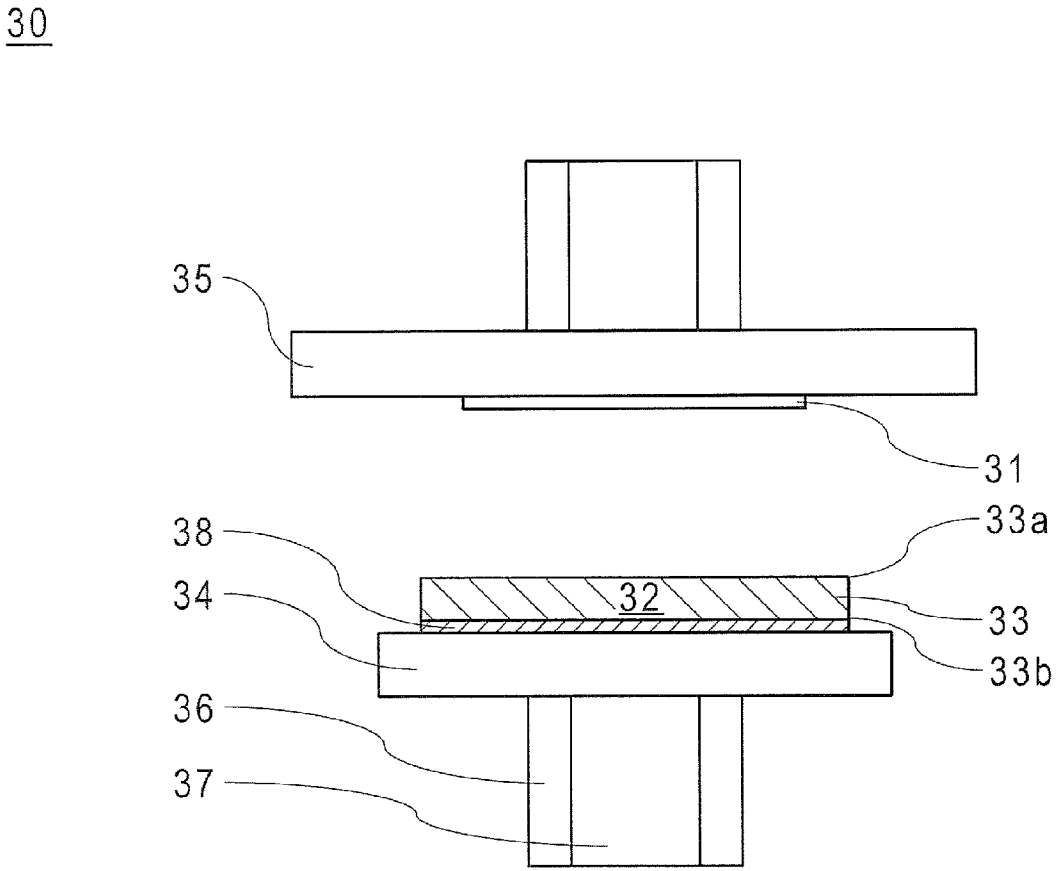
FIG. 2A is a view illustrating a polishing device in one embodiment of the present invention.

Referring to FIG. 2A, it is a preferred embodiment of the polishing device according to the present invention. As shown in FIG. 2A, a polishing device 30 includes a first platform 34, a second platform 35, a driving device 36, a pressure device 37 and a polishing pad 32. The polishing pad 32 is made by at least one substrate 33. The substrate 33 includes a polishing surface 33*a* and a reverse surface 33*b* corresponding to the polishing surface 33*a*. The first platform 34 is coupled to the reverse surface 33*b* of the substrate 33. The second platform 35 is used to carry the semiconductor element 31. The driving device 36 is used to drive the first platform 34 to rotate. The pressure device 37 is used to generate a specific pressure between the polishing pad 32 of the first platform 34 and the semiconductor element 31 of the second platform 35. The polishing pad 32 is characterized by: a pressure sensitive adhesive 38 is formed on the reverse surface 33*b* of the substrate 33 and used to couple with the first substrate 34. The horizontal adhesion of the pressure sensitive adhesive 38 is higher that the vertical adhesion of the pressure sensitive adhesive 38. Because the horizontal adhesion of the pressure sensitive adhesive 38 is higher, the polishing pad 32 is not easy to be peeled off because of the shear force generated by the polishing device 30. Because the vertical adhesion of the pressure sensitive adhesive 38 is lower, the polishing pad 32 is easy to release from the polishing device 30. The horizontal adhesion of the pressure sensitive adhesive 38 is about 0.3-3 kg/cm and the vertical adhesion of the pressure sensitive adhesive 38 is about 0.05-0.55 kg/cm.

According to the description above, the substrate 33 is a polymer. The polymer is elected from the group consisted of polycarbonate, nylon, polyolefin, polyvinyl alcohol, polyacrylate, polytetrafluoroethylene, polyethylene terephthalate, polyimide, poly amide, poly aryl stretch, poly styrene, polymethyl methacrylate and compound thereof. Besides, there is at least one of transparent window, trench or through hole disposed on the polishing surface 33*a* of the first substrate 33. The transparent window disposed on the polishing pad 33*a* of the first substrate 33 is used to observe the polishing of the semiconductor. The trench or through hole disposed on the polishing pad 33*a* of the first substrate 33 is used to let the polishing liquid evenly spread on the polishing pad 33*a* of the first substrate 33 and avoid the scratch of the semiconductor generated by the deposition of the impurities during polishing. The method to dispose the transparent window, trench or through hole on the polishing pad 33*a* of the substrate 33 is a prior art and the detail description is omitted herein.

Figure 2B:
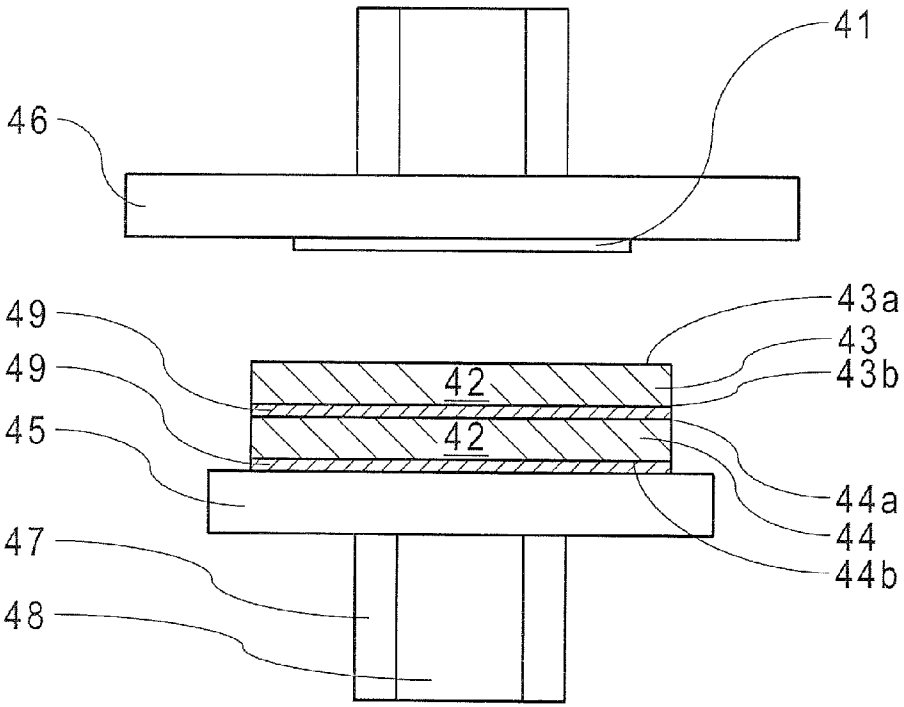
FIG. 2B is a view illustrating a polishing device in one embodiment of the present invention.

Referring to FIG. 2B, it is another preferred embodiment of the polishing device according to the present invention. As shown in FIG. 2B, a polishing device 40 includes a first platform 45, a second platform 46, a driving device 47, a pressure device 48 and a polishing pad 42. The polishing pad 42 is made by at least one first substrate 43 and at least one second substrate 44. The first substrate 43 and the second substrate 44 respectively includes a polishing surface 43*a* and 44*a* and a reverse surface 43*b* and 44*b* respectively corresponding to the polishing surface 43*a* and 44*a*. The first platform 45 is coupled to the reverse surface 44*b* of the second substrate 44. The second platform 46 is used to carry the semiconductor element 41. The driving device 47 is used to drive the first platform 45 to rotate. The pressure device 48 is used to generate a specific pressure between the polishing pad 42 of the first platform 45 and the semiconductor element 41 of the second platform 46. The polishing pad 42 is characterized by: a pressure sensitive adhesive 49 is formed on the reverse surface 43*b* of the first substrate 43 and used to couple with the polishing surface 44*a* of the second substrate 44. A plurality of the polishing pads 42 is coupled together to form a compound polishing pad. A pressure sensitive adhesive 49 is formed on the reverse surface 44*b* of the second substrate 44 and used to couple with the first platform 45. The horizontal adhesion of the pressure sensitive adhesive 49 is higher than the vertical adhesion of the pressure sensitive adhesive 49. Because the horizontal adhesion of the pressure sensitive adhesive 49 is higher, the polishing pad 42 is not easy to be peeled off because of the shear force generated by the polishing device 40. Because the vertical adhesion of the pressure sensitive adhesive 49 is lower, the polishing pad 42 is easy to release from the polishing device 40. The horizontal adhesion of the pressure sensitive adhesive 49 is about 0.3-3 kg/cm and the vertical adhesion of the pressure sensitive adhesive 49 is about 0.05-0.55 kg/cm.

According to the description above, the shape and the area of the first substrate 43 and the second substrate 44 are almost the same. The first substrate 43 includes a first polymer and the second substrate 44 includes a second polymer. The first polymer and the second polymer are elected from the group consisted of polycarbonate, nylon, polyolefin, polyvinyl alcohol, polyacrylate, polytetrafluoroethylene, polyethylene terephthalate, polyimide, poly amide, poly aryl stretch, poly styrene, polymethyl methacrylate and compound thereof. The first substrate 43 and the second substrate include at least one property. The property is selected from the group consisting of hardness, density, porosity, compressibility, rigidity, tensile modulus, bulk modulus of elasticity, transparency, chemical composition, rheology, creep, glass transition temperature, melting temperature, viscosity and combination thereof. In addition, if the first substrate 43 includes a multi-holes structure, the second substrate 44 includes a hole less structure and vise versa. Besides, there is at least one of transparent window, trench or through hole disposed on the polishing surface 43*a* of the first substrate 43. The transparent window disposed on the polishing pad 43*a* of the first substrate 43 is used to observe the polishing of the semiconductor. The trench or through hole disposed on the polishing pad 43*a* of the first substrate 43 is used to let the polishing liquid evenly spread on the polishing pad 43*a* of the first substrate 43 and avoid the scratch of the semiconductor generated by the deposition of the impurities during polishing. The method to dispose the transparent window, trench or through hole is a prior art and the detail description is omitted herein.

Although specific embodiments have been illustrated and described, it will be appreciated by those skilled in the art that various modifications may be made without departing from the scope of the present invention, which is intended to be limited solely by the appended claims.

What is claimed is:

1. A polishing pad used in semiconductor polishing process includes a substrate, said substrate includes a polishing surface and a reverse surface corresponding to said polishing surface, and said polishing pad is characterized by:

a pressure sensitive adhesive formed on said reverse surface of said substrate and used to couple with a bottom layer, and said horizontal adhesion of said pressure sensitive adhesive is higher than said vertical adhesion of said pressure sensitive adhesive and said reverse surface of said substrate is binding with said bottom layer instead of separating.

2. The polishing pad according to claim 1, wherein said horizontal adhesion of said pressure sensitive adhesive is about 0.3-3 kg/cm.

3. The polishing pad according to claim 1, wherein said vertical adhesion of said pressure sensitive adhesive is about 0.05-0.55 kg/cm.

4. The polishing pad according to claim 1, wherein said bottom layer is a thin film.

5. The polishing pad according to claim 4, wherein said thin file is a PET Mylar.

6. The polishing pad according to claim 1, wherein said substrate and said bottom layer include at least one different property.

7. The polishing pad according to claim 6, wherein said property is selected from the group consisting of: hardness, density, porosity, compressibility, rigidity, tensile modulus, bulk modulus of elasticity, transparency, chemical composition, rheology, creep, glass transition temperature, melting temperature, viscosity and combination thereof.

8. The polishing pad according to claim 1, wherein said substrate is a polymer.

9. The polishing pad according to claim 8, wherein said polymer is elected from the group consisted of polycarbonate, nylon, polyolefin, polyvinyl alcohol, polyacrylate, polytetrafluoroethylene, polyethylene terephthalate, polyimide, poly amide, poly aryl stretch, poly styrene, polymethyl methacrylate and compound thereof.

10. A polishing pad used in semiconductor polishing process includes at least one first substrate and at least one second substrate, said first substrate and said second substrate respectively include a polishing surface and a reverse surface corresponding to said polishing surface, and said polishing pad is characterized by:

a pressure sensitive adhesive formed on said reverse surface of said first substrate and used to couple with said polishing surface of said second substrate, and said horizontal adhesion of said pressure sensitive adhesive is higher than said vertical adhesion of said pressure sensitive adhesive and said reverse surface of said first substrate is binding with said polishing surface of said second substrate instead of separating during polishing, and one of said first substrate and said second substrate include a multi-hole structure and another includes a hole less structure.

11. The polishing pad according to claim 10, wherein said horizontal adhesion of said pressure sensitive adhesive is about 0.3-3 kg/cm.

12. The polishing pad according to claim 10, wherein said vertical adhesion of said pressure sensitive adhesive is about 0.05-0.55 kg/cm.

13. The polishing pad according to claim 10, wherein said first substrate and said second substrate include at least one different property.

14. The polishing pad according to claim 10, wherein said first substrate includes a first polymer and said second substrate includes a second polymer.

15. The polishing pad according to claim 10, further includes a bottom layer used to couple with said polishing pad.

16. The polishing pad according to claim 15, wherein said polishing pad is disposed on said reverse surface of said second substrate and forms a pressure sensitive adhesive to couple with said bottom layer.

17. The polishing pad according to claim 15, wherein said bottom layer is a thin film.

18. The polishing pad according to claim 15, wherein said first substrate, said second substrate and said bottom layer include at least one different property.

19. The polishing pad according to claim 15, wherein said bottom layer includes a third polymer.

20. A polishing device including a first platform, a second platform, a driving device, a pressure device and a polishing pad, and said polishing pad is made by at least one substrate, said substrate includes a polishing surface and a reverse surface respectively corresponding to said polishing surface, said first platform is coupled to said reverse surface of said substrate, said second platform is used to carry said semiconductor element, said driving device is used to drive said first platform to rotate, said pressure device is used to generate a specific pressure between said polishing pad of said first platform and said semiconductor element of said second platform, wherein said polishing pad is characterized by:

a pressure sensitive adhesive is formed on said reverse surface of said substrate and used to couple with said first platform, and said horizontal adhesion of said pressure sensitive adhesive is higher than said vertical adhesion of said pressure sensitive adhesive and said reverse surface of said substrate is binding with said first platform instead of separating during polishing.

* * * * *